United States Patent [19]

Baginski et al.

[11] Patent Number: 4,649,244

[45] Date of Patent: Mar. 10, 1987

[54] CONTROL DEVICE OF AN ELECTRIC CIRCUIT BREAKER

[75] Inventors: Pierre Baginski, Grenoble; Jean-Pierre Nebon, St. Martin-le-Vinoux, both of France

[73] Assignee: Merlin Gerin, Grenoble, France

[21] Appl. No.: 692,699

[22] Filed: Jan. 18, 1985

[30] Foreign Application Priority Data

Jan. 30, 1984 [FR] France ..... 8401527

[51] Int. Cl.[4] ..... H01H 3/30

[52] U.S. Cl. ..... 200/153 SC; 200/303; 200/325

[58] Field of Search ..... 200/153 SC, 153 G, 153 H, 200/318-325, 303, 307

[56] References Cited

U.S. PATENT DOCUMENTS

| | | | |
|---|---|---|---|
| 2,820,119 | 1/1958 | Miller et al. | 200/153 SC |
| 2,856,566 | 10/1958 | Fornwalt | 361/74 |
| 2,896,621 | 8/1958 | Coggeshall et al. | 200/153 SC |
| 3,084,238 | 4/1963 | Baskerville | 200/153 SC |
| 3,729,065 | 4/1973 | Baskerville et al. | 200/153 SC X |
| 3,806,684 | 4/1974 | Hauser | 200/153 SC |
| 4,110,582 | 8/1978 | Barkan | 200/153 SC |
| 4,153,828 | 5/1979 | Barkan | 200/153 SC |
| 4,166,205 | 8/1979 | Maier et al. | 200/153 G |
| 4,439,653 | 3/1984 | Umino et al. | 200/153 SC |

FOREIGN PATENT DOCUMENTS

| | | |
|---|---|---|
| 0062414 | 10/1982 | European Pat. Off. . |
| 0080636 | 6/1983 | European Pat. Off. . |
| 2201938 | 7/1973 | Fed. Rep. of Germany . |
| 2835879 | 3/1979 | Fed. Rep. of Germany . |
| 2356994 | 1/1978 | France . |
| 1405747 | 9/1975 | United Kingdom . |
| 1551623 | 8/1979 | United Kingdom . |

*Primary Examiner*—Stephen Marcus
*Assistant Examiner*—Ernest G. Cusick
*Attorney, Agent, or Firm*—Parkhurst & Oliff

[57] ABSTRACT

The electric control to reset a circuit breaker is formed by a sub-assembly (10) to be coupled to the mechanism (60) of the circuit breaker. At the end of the charging travel of the closing spring a control cam (46) disconnects and stops the motor. The charging position is defined by a latch interlocking the charging cam (62), a closing operation being induced by the release of the latch and a limited rotation of this charging cam (62). The link shaft between the motor reducing sub-assembly or block (10) and the mechanism (60) transmits this closing limited rotation to the control cam (46), which induces the restarting and the connecting of the motor for a reset operation of the closing spring.

3 Claims, 6 Drawing Figures

CONTROL DEVICE OF AN ELECTRIC CIRCUIT BREAKER

BACKGROUND OF THE INVENTION

The invention relates to a control device of an electric circuit breaker having a pair of contacts and an opening spring mechanism to shift the moving contact to an open position and a closing spring mechanism to shift the moving contact to a closed position, the charging of the opening spring occurring at the time of the closing operation and the charging of the closing spring being carried out by a cam driven in rotation by a motor, said reset cam cooperating with a roller mechanically connected on one hand to the closing spring and on the other hand to the moving contact. The profile of the cam shows three successive sectors, a first sector of the roller shift by rotation of the cam to charge the closing spring, a second sector during which the action of the closing spring on the cam through the roller tends to follow the cam rotation and a third sector of the roller release for a snap closing operation of the contacts by the closing spring, a latch being capable of interlocking the cam in the active position of said second sector.

A control device of the mentioned type permits a snap action closing of a single-pole or multipole circuit breaker by the simple release of the latch, the spring ensuring the snap closing. The reset of the closing spring occurs, either manually, or by an electric motor as soon as the circuit breaker is closed in order to be ready for a new operation in case of the circuit breaker opening. Such devices are adapted to low voltage with very high intensity circuit breakers which require large operating forces that are difficult to employ by a simple pull or a handle. In this known device the reset electric control is combined with the mechanism of the circuit breaker and limits the possibilities to use the latter.

The object of the present invention is to improve this known device and to permit the realization of a modular system

SUMMARY OF THE INVENTION

According to the invention the control device comprises a means for detection of the cam rotation from the active position of the second sector toward the active position of the third sector, said detection means controlling a reset operation of the closing spring by rotation of the cam by said motor.

The cam ensures the control function of a reset operation of the closing spring in addition of its functions of the spring charging and of reducing down the unlock effort. This permits to simplify the device and essentially to group all the elements of the charging electric control in a subassembly being able to be coupled easily and without any risk of error to a mechanism of circuit breaker. The advantages of reducing the manufacturing and stocking cost of the modular systems are known and the present invention permits the realization of a completely prewired electric charging control which only requires a single point of mechanical link with the circuit breaker mechanism at the time of its adaptation.

According to an embodiment of the invention the detection means controlling the reset of the closing spring ensures in the same time the cut-off of the motor and/or the disconnecting of the latter at the end of charging travel of the spring. The sub-assembly forming the charging electric control comprises an output shaft suitable to be coupled to a shaft of the circuit breaker mechanism and more especially to the shaft carrying the reset cam. The coupling between the two shafts must prevent any angular shift and allow a coupling only for a well defined relative position of the two shafts. On the one hand this coupling transmits the drive force in rotation of the cam for the charging of the closing spring and on the other hand transmits a signal of the cam position controlling the reset operation by starting up the electric motor of the control.

BRIEF DESCRIPTION OF THE DRAWINGS

Other advantages and technical data will more clearly appear from the following description, wherein reference is made to the accompanying drawings, in which.

DESCRIPTION OF A PREFERRED EMBODIMENT

Figure 1:
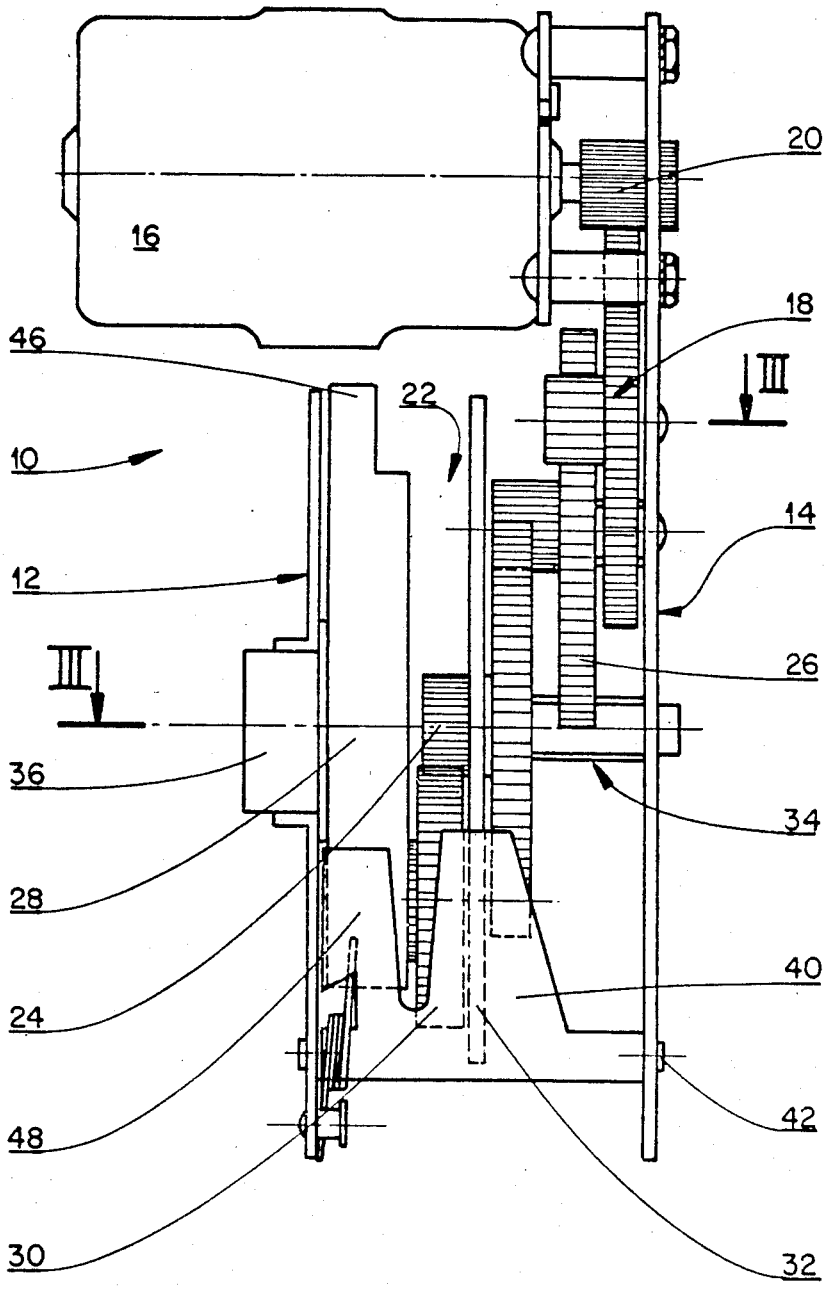
FIG. 1 is a schematic elevational view of the sub-assembly of electric charging of a closing spring of a device according to the invention.

On the Figures the frame of a motor reducing block or motor reductor 10 of electric control is made by two sideplates 12, 14, between which is mounted a reducing gearing train 18 driven in rotation by a pinion 20 of an electric motor 16. The outlet of the gearing train 18 comprises a differential mechanism 22 having a first planetary system 24 driven in rotation by the last cog-wheel 26 of the train 18 and a second planetary system 28 in the form of a crown-wheel with internal cogs. Between the planetary systems 24, 28 are cut in satellites 30 carried by a satellite-holder plate 32, mounted loose on the output shaft 34 carrying the last cog-wheel 26. The planetary crown-wheel 28 carries a coupling socket 36 forming the outlet of the motor reducing sub-assembly 10. The satellite-holder plate 32 shows around its outside circumference interlock teeth 38 capable of cooperating with a pawl 40 mounted in rotation on an axis 42 and biased by a spring 44 in interlock position of the satellite-holder plate 32. The planetary crown-wheel 28 carries on its outside periphery a finger 46 capable of actuating a lever 48 locked with the pawl 40. The lever 48 shows a boss 52 capable of actuating the lever 54 of a normally-closed switch 50 inserted in the supply circuit of the motor 16.

Figure 2:
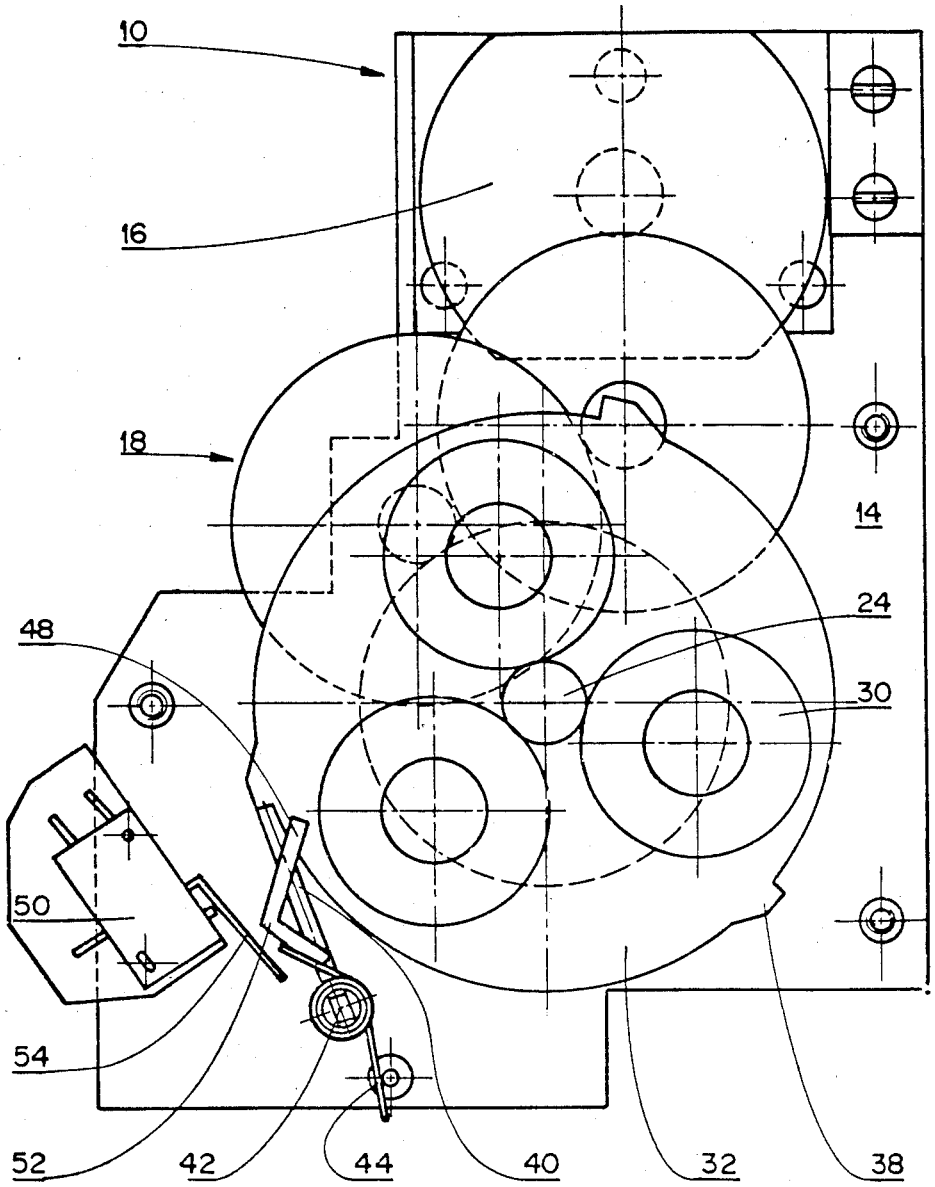
FIG. 2 is a side view of the device according to FIG. 1, one of the lateral sideplates being assumed removed.

In interlocked position of the satellite-holder plate 32 by the pawl 40, the electric switch 50 is closed and the electric motor 16 drives in rotation the coupling socket 36 by the reducing train 18 and the differential mechanism 22. During the rotation of the planetary crown-wheel 28 (not shown in FIG. 2), the finger 46 engages the lever 48 by causing it to rotate around the axis 42. This rotation of the lever 48 induces on one hand the opening of the contact 50 cutting off the electric supply of the motor 16, and on the other hand the release of the pawl 40 which sets the satellite-holder plate 32 free. As soon as the satellite-holder plate 32 is free the latter can freely rotate and the transmission between the planetary systems 24 and 28 is stopped. This disconnecting suddenly stops the drive in rotation of the socket 36, the motor 16 being able to carry on its rotation until its normal stop, due to switch 50 interrupting the electric current supply to motor 16. It is clear that the sudden stop of the socket 36 can be generated in a different way, for instance by a brake system automatically locking the motor 16 as soon as the lever 48 is actuated by the finger 46. To start a new drive cycle the rotation of the planetary plate 28 is enough to release the lever 48 from the finger 46. The rotation of the assembly lever 48 and pawl 40 under the action of the pull-off spring 44 induces on one hand the closing of the switch 50 and the starting of the motor 16, and on the other hand the locking of the satellite-holder plate 32 restoring the cinematic link between the motor 16 and the coupling socket 36. The sub-assembly 10 forms an autonomous motoreductor being able to be assembled and pre-wired before its adaptation to the circuit breaker mechanism.

Figure 3:
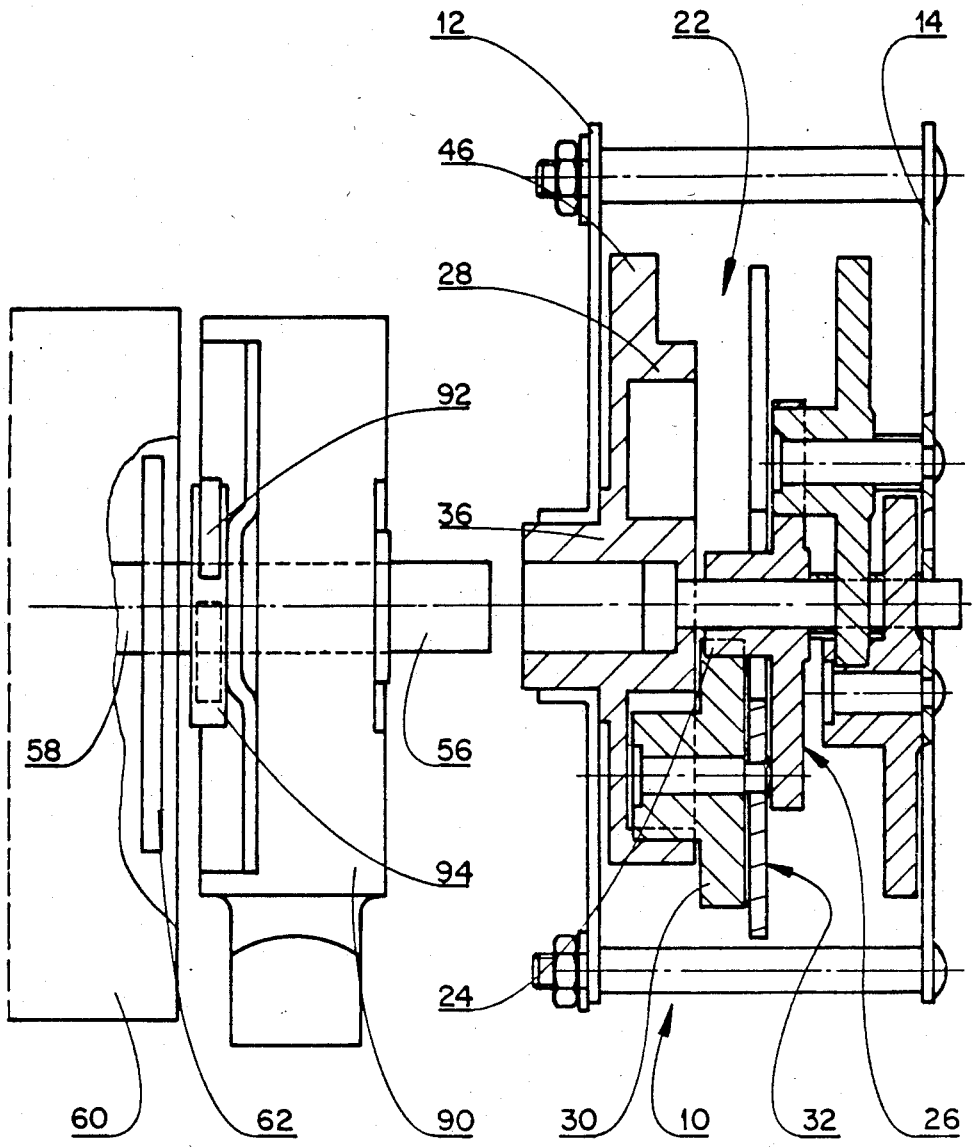
FIG. 3 is a section viewed along the line III—III of FIG. 1, showing the sub-assembly in position ready to be coupled to a shaft of the control mechanism of a circuit breaker.
Figure 4:
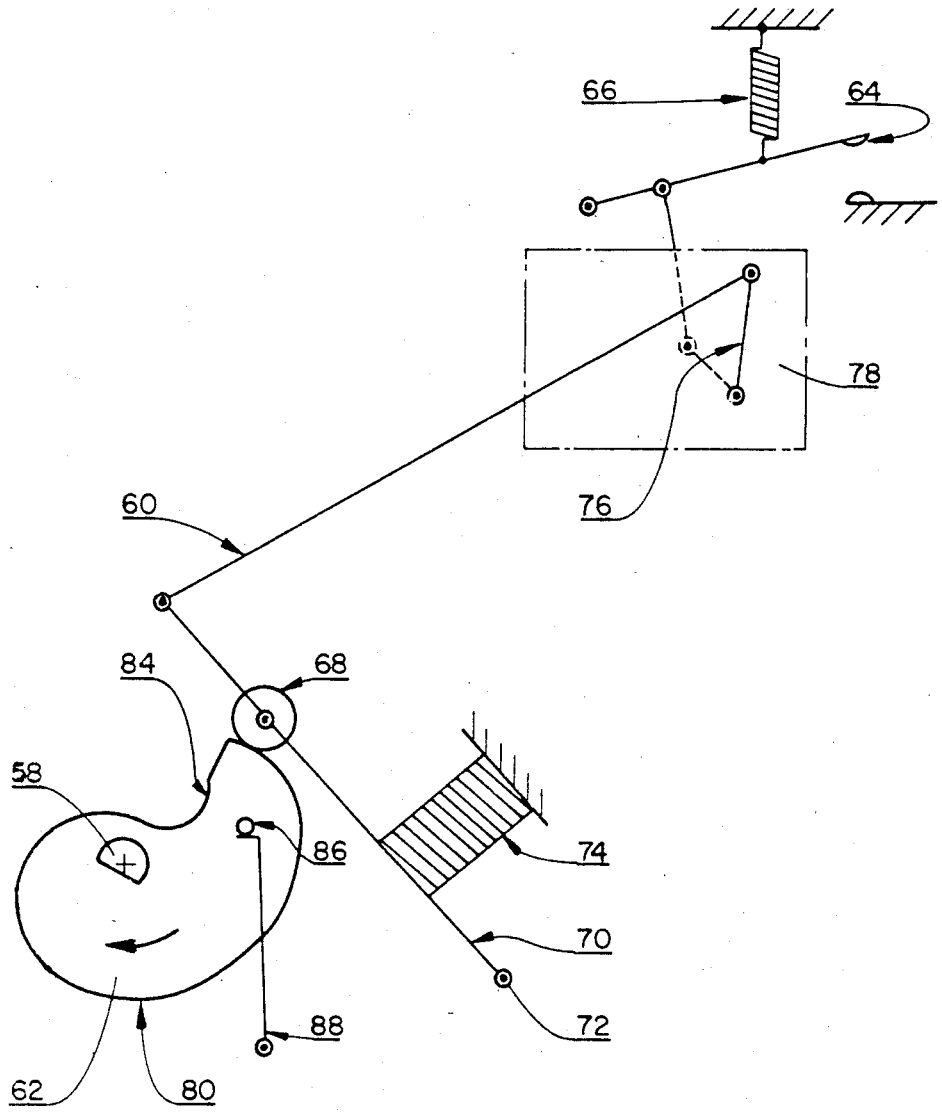
FIGS. 4 and 5 schematically illustrate a part of the mechanism of the circuit breaker represented at the end of the charging travel of the closing spring and in discharging position of this spring respectively.
Figure 5:
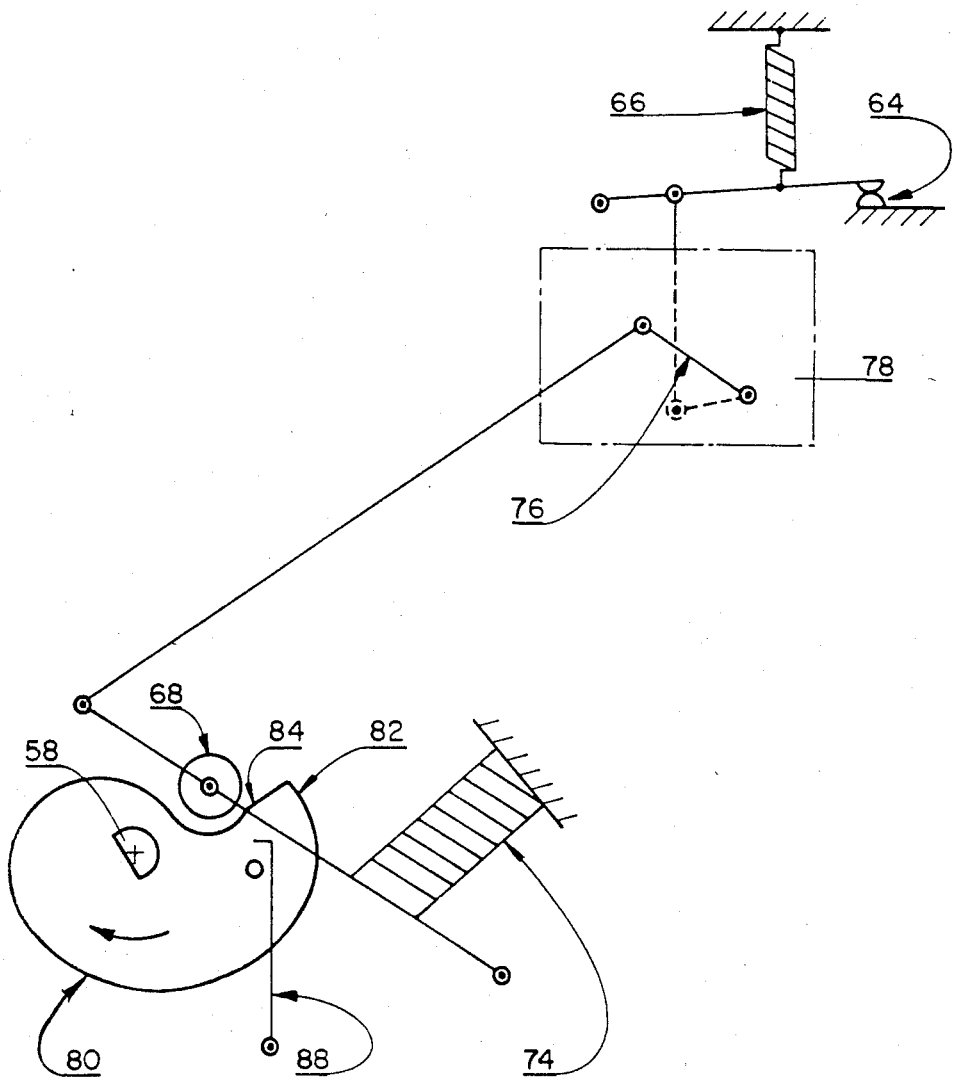

Referring more especially to FIG. 3, it can be seen that the motor reducing block 10 is capable of being coupled by engagement of the socket 36 on an end 56 of a shaft 58 to a mechanism 60 of which only the terminal part is represented. The mechanism 60 comprises a reset cam 62 cottered on the shaft 58 and it controls the opening and the closing of contacts 64, schematically represented in FIG. 4 and FIG. 5. The mechanism 60 does not belong to this present invention and will not be described in detail, this mechanism being able to be for example of the type described in the U.S. Pat. No. 4,166,205 or of an analogous type. It is enough to recall that the contacts 64 are biased in opening position by an opening spring 66 and that the mechanism 60 permits a control to close the contacts 64, for example by a toggle system well known in the art. The mechanism 60 also comprises thermal or magnetic releases inducing the automatic opening of the contacts 64 in case of overload or fault. The cam 62 cooperates with a roller 68 carried by a lever 70 mounted in rotation on an axis 72. A closing spring 74 biases the lever 70 in support of the cam 62, the free end of the lever 70 being connected by a system of connecting rods 76 to the so-called control of the circuit breaker represented by a simple block 78 in FIGS. 4 and 5. The profile of the cam 62 comprises three successive sectors, a first sector 80 for the charging of the closing spring 74, the lever 70 being pushed away clockwise during the rotation of the cam 62, so as to move apart from the shaft 58 by compressing the spring 74. The second sector 82 of very limited strength initiates an opposite rotation of the lever 70 under the action of the closing spring 74. The third sector 84 corresponds to a release of the roller 68 allowing a counterclockwise sudden rotation of the lever 70 under the action of the closing spring 74. The charging cam 62 carries a finger 86 arranged so as to come to a stop of a latch 88, in active position of the second sector 82, represented in FIG. 4. In this position the closing spring 74 is charged, the contacts 64 being either opened or closed according to the state of the control 78. The roller 68 in support of the second sector 82 exerts a torque on the cam 62 biasing the latter in clockwise rotation. The latch 88 is opposed to this rotation and the position represented in FIG. 4 is a stable position. After the opening of the contacts 64 by the control 78, especially when a fault occurs, a closing operation can be tripped by the rotation of the latch 88 releasing the finger 86. Under the action of the roller 68 the cam 62 pivots clockwise bringing the third sector 84 in active position to release the roller 68. The closing spring 74 causes the lever 70 to pivot counterclockwise and transmits a closing force to the control 78 shifting the contacts 64 in closed position against the force of the opening spring 66, which is automatically charged by the closing operation. To reset the closing spring 74 it is enough to drive in rotation the shft 58, for example by the motor reductor 10, clockwise, until the coming in active position of the second sector 82. From the transit of the first sector 80 toward the second sector 82 the roller 68 initiates a shift in the opposite direction by exerting on the cam 62 a force taking part in its clockwise drive. From this transit the cam automatically carries on its rotation until the coming to a stop of the finger 86 on the latch 88, the drive force of the shaft 58 being stopped during this roller shift along the second sector 82. It is advisable to note that the cam 62 always turns in the same direction and holds two stable positions, one charged position, represented in FIG. 4, in which the cam is interlocked by the latch 88, and a discharged position, represented in FIG. 5. Such a mechanism is well known of the specialists and it will be enough for the reader to refer to the above-mentioned U.S. Pat. No. 4,166,205 to obtain greater details on a realization and its operation modes.

The rotation of the shaft 58 can be controlled by a manual handle 90 schematiclly represented in FIG. 3. This handle 90 is mounted loose on the shaft 58 and cooperates by a system of drive and non-return pawls 92 with a cog-wheel 94 cottered on the shaft 58. A reciprocating tipping of the handle 90 induces an intermittent drive in the same direction of the shaft 58, the pawl system 92 permitting a rotation of the shaft 58 in the same direction, independantly of the handle 90. Such drive systems are well known. The reset of the closing spring 74 can also be carried out by the motor reductor 10 coupled to the shaft 58. The conjugated sections of the end 56 of the shaft 58 and the coupling socket 36 present a flat 96 defining thoroughly the position of the shaft 58 with regard to the socket 36. Consequently the sub-assembly 10 can be coupled to the mechanism 60 only for a single and thoroughly defined positioning of the socket 36 with regard to the shaft 58.

Figure 6:
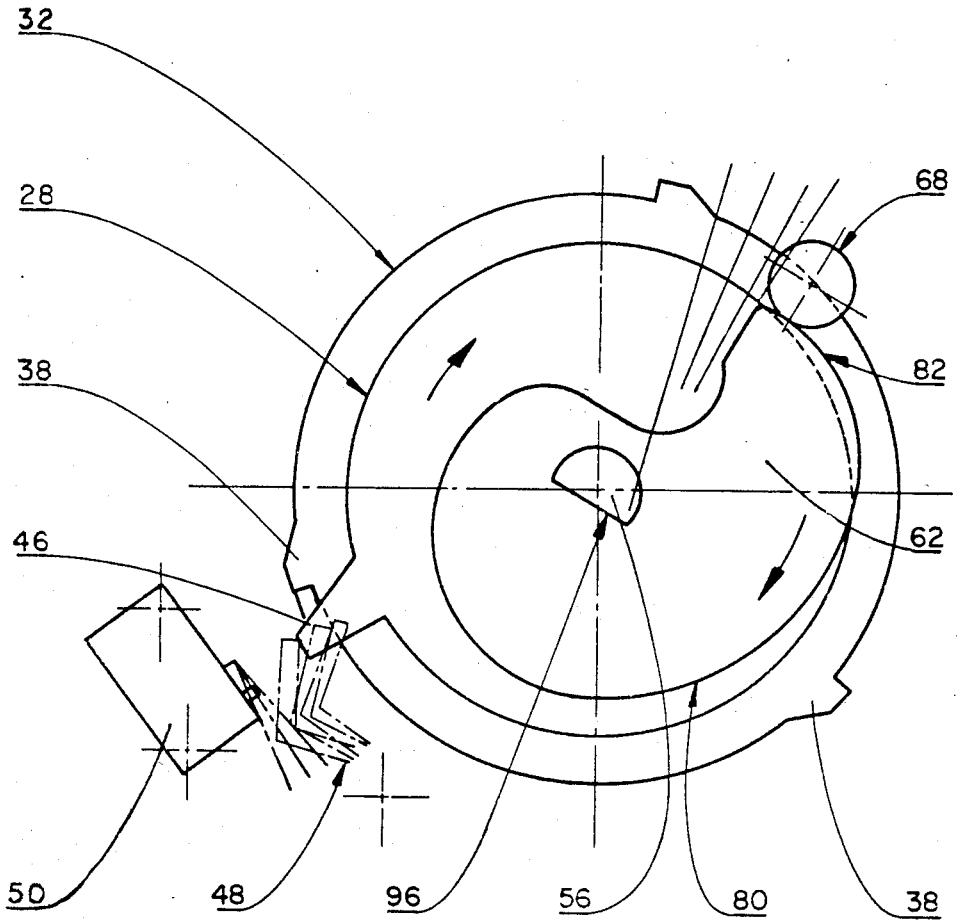
FIG. 6 represents the respective positions of the cam and the control means of the reset electric motor.

According to the invention the mode of operation of the control device is more particularly described below referring to FIG. 6, which represents only the essential parts necessary for the understanding of the description:

In the charged position of the closing spring 74, the roller 68 cooperates with the second sector 82 of the cam 62 by exerting on the latter a torque leading to make it turn clockwise, as indicated by the arrows in FIG. 6. In this charging position the cam 62 is held by the latch 88. The finger 46 of the planetary crown 28, the position of which is thoroughly defined with regard to that of the cam 62 by the flat coupling 96, engages the lever 48 by inducing the opening of the switch 50 and the release of the satellite-holder plate 32. The electric motor 16 is not supplied, the assembly being ready for a closing operation. Such a closing operation is tripped by the rotation of the latch 88 allowing a clockwise rotation of the cam 62 in FIG. 6. During this rotation the roller 68 leaves the second sector 82, the lever 70 pivoting under the action of the closing spring 74 to close the contacts 64 of the circuit breaker. The rotation of the cam 62 stops as soon as the roller 68 leaves the second sector 82, but this limited rotation is exactly transmitted by the flat coupling 96 to the planetary system 28. It is enough to shift the finger 46 and release the lever 48 to close the switch 50 and to engage the pawl 40. The motor 16, supplied by the closing of the switch 50, drives in rotation the gearing train 18 and through the locked differential 22 the shaft 58 and the cam 62. This rotation is carried on during the whole charging travel corresponding to the first sector 80 of the cam 62. The transit of the roller 68 from the first sector 80 toward the second sector 82 corresponds to the coming of the finger 46 into contact with the lever 48. The assembly is disposed so as the disconnecting induced by the release of the pawl 40 occurs just after the transit of the roller 68 on the second sector 82, this disconnecting stopping the drive in rotation of the shaft 58 and of the cam 62 by the motor 16. The cam 62 carries on its travel under the action of the closing spring 74 until the coming to a stop on the latch 88. The disconnected planetary system 28 of the motor 16 rotates with the cam 62 in its limited travel, the finger 46 being disposed to hold the lever 48 in its pivoted position during its limited travel. Simultaneously with the disconnecting induced by the release of the pawl 40 or just after this disconnecting the switch 50 is opened to cut off the supply of the motor 16. This opening of the switch 50 occurs in any case before the coming to a stop of the cam 62 on the latch 88. Thus, it can be assured that in the charging position, represented in FIG. 6, the motor 16 is stopped and disconnected, the cam 62 being in a position ready for a closure operation. The starting order of the morot reductor block 10 after a closure operation is transmitted by the link shaft 58 and it is unnecessary to provide for an additional connection or link for this starting control. The link by flat part 96 prevents any shift between the cam 62 and the planetary system 28 ensuring a thorough synchronization of the successive displacements and controls. The mount of the the motor reducing block or sub-assembly on the circuit breaker does not require any elaborate operation since it is simplified merely to a fitting of the socket 36 on the end 56 and this mounting can be realized by the end user or the distributor. The profile of the second sector 82 of the cam 62 limits the forces exerted on the latch 88 as the number of lâtches of the control.

We claim:

1. A control device for an electric circuit breaker having stationary and movable contacts, an opening spring for shifting the movable contact to an open position, a closing spring for shifting the movable contact to a closed position, an opening spring charging mechanism for charging the opening spring at the time the movable contact is moved to its closed position, and a closing spring charging mechanism including a shaft and a cam mounted on said shaft; a motor for driving said shaft in rotation in a predetermined direction; a cam-follower roller mechanically coupled to said closing spring and to said movable contact; said cam having a profile including three successive sectors:

a first sector effecting shift of said roller by rotation of said cam to charge said closing spring, a second sector at which the action of the closing spring, through said roller, on said cam is such as to urge the cam in rotation in said predetermined direction, and a third sector in which the roller is released for snap-action shifting, by the closing spring, of the circuit breaker movable contact to its closed position;

latch means for latching the cam in a position wherein said roller is at said second cam sector; and detection means, actuated by rotation of said shaft, for detecting a position of said cam and for controlling the charging operation of the closing spring by terminating the rotation of the cam by said motor; said detection means and said motor being grouped into a preassembled motor reducing sub-assembly, the circuit breaker, cam, shaft, and opening and closing springs being grouped in another sub-assembly, said motor reducing sub-assembly being couplable to said shaft; and a mechanical linkage connecting said motor and said shaft, said linkage including disconnecting means for stopping said motor and for disconnecting said linkage when said roller is disposed at said second sector of said cam.

2. Control device according to claim 1, wherein said disconnecting means initiates a closing spring charging operation by starting said motor and reconnecting said linkage when said cam rotates to a position wherein said roller is at said third cam sector.

3. Control device according to claim 1, wherein said mechanical linkage includes a differential planetary gear system including planet gear holder plate, and latch means for latching said planet gear holder plate during rotation of the cam to connect said linkage for charging the closing spring and for releasing the planet gear holder plate to disconnect said linkage when said roller is at said second cam sector.

* * * * *